United States Patent [19]

Beitz et al.

[11] Patent Number: 4,901,942

[45] Date of Patent: Feb. 20, 1990

[54] WARPING MILL AND DISK THREAD BRAKE

[75] Inventors: Jurgen Beitz, Neumunster; Karl-Heinz Erren, Aukrug-Homfeld; Gunter Mobius, Westerronfeld, all of Fed. Rep. of Germany

[73] Assignee: Norddeutsche Faserwerke GmbH, Neumunster, Fed. Rep. of Germany

[21] Appl. No.: 95,435

[22] Filed: Sep. 3, 1987

[30] Foreign Application Priority Data

Sep. 3, 1986 [DE] Fed. Rep. of Germany ..... 3629928

[51] Int. Cl.[4] ..... B65H 59/27; F16D 65/24

[52] U.S. Cl. ..... 242/150 R; 188/170; 188/65.1; 242/156

[58] Field of Search ..... 188/65.1, 71.1, 72.1, 188/72.3, 72.4, 170, 151 R; 139/349; 242/156, 156.1, 156.2, 150 R

[56] References Cited

U.S. PATENT DOCUMENTS

| | | | |
|---|---|---|---|
| 712,833 | 11/1902 | Moore | 188/170 |
| 2,646,943 | 7/1953 | Lindsay | 188/65.1 |
| 3,200,906 | 8/1965 | Bernard | 188/65.1 |
| 3,613,839 | 10/1971 | MacDuff | 188/170 |
| 3,661,234 | 5/1972 | Moederndorfer et al. | 188/72.3 X |
| 3,709,332 | 1/1973 | Rosen | 188/71.1 |
| 4,641,688 | 2/1987 | Gehring | 188/65.1 X |

FOREIGN PATENT DOCUMENTS

| | | | |
|---|---|---|---|
| 1057536 | 5/1959 | Fed. Rep. of Germany | 188/151 R |
| 1082230 | 12/1954 | France | 188/65.1 |
| 2384994 | 11/1978 | France | 188/72.4 |
| 2521506 | 8/1983 | France | 188/170 |
| 0418922 | 2/1967 | Switzerland | 242/150 |
| 0564478 | 7/1975 | Switzerland | 188/65.1 |
| 0704878 | 12/1979 | U.S.S.R. | 242/150 R |
| 0889914 | 2/1962 | United Kingdom | 188/72.4 |

*Primary Examiner*—Andres Kashnikow
*Assistant Examiner*—Richard Potosnak
*Attorney, Agent, or Firm*—Oblon, Spivak, McClelland, Maier & Neustadt

[57] ABSTRACT

A clamping brake for selectively braking each thread in a warp mill having a plural number of threads includes first and second brake disks which can move together to brake a thread in a thread guide positioned between the brake disks. The second brake disk is moved by pneumatic fluid, opposed by either gravity or a spring force.

5 Claims, 3 Drawing Sheets

WARPING MILL AND DISK THREAD BRAKE

BACKGROUND OF THE INVENTION

During warping, while running off the creel, each thread is commonly held by a brake, in order to put it on the beam with uniform tension. In high-speed warping mills, such braking is undesired, since the resistances at thread guides to the beam already impart sufficient tension to the thread. In addition, in high-speed warping mills, a brake would lead to too high a thread tension.

On the other hand, however, it is necessary to brake the thread moving at high speed in order to avoid continued pay-out when the warping mill has to be suddenly stopped or braked, e.g.—because of a thread fault. In such high-speed warping mills, clamping brakes have therefore been provided for each thread. These clamping brakes have been mechanically actuated (i.e., when the warping beam rotation is stopped, the clamping brakes are switched on, brought into the braking position, and are released again after the warping beam is started).

However, the mechanics of operation of such clamping brakes are very slow and, because of the large number of thread brakes on the warping mill, hard to handle. When the warping beam rotation is stopped in warping mills with a large number of threads, in particular, it is virtually impossible to switch on all thread brakes fast enough to prevent with certainty additional pay-out of threads. Similarly, when the warping mill is started, it is virtually impossible to release all the brakes before high speeds are attained, in order to prevent too high a tension on the threads.

SUMMARY OF THE INVENTION

According to the present invention, these difficulties are eliminated or ameliorated. For each thread of a warping mill, a disk thread brake is used as a clamping brake. The disk thread brake can be switched on and off by pressure gas (for instance, compressed air) working against the force of gravity or an elastic force. By opening a valve, all disk thread brakes of the warping mill can be closed or opened within a very short time. Additionally, the compressed air feed piping can be easily installed.

GENERAL DISCUSSION OF THE INVENTION

A disk thread brake according to the invention satisfying, the above described requirements includes of a housing which carries the bottom disk and the gas supply to a system expandable by gas pressure. A member is axially movable in the housing and is frictionally connected to a system that is expandable by gas pressure and that has a spindle carrying the upper disk. When the gas pressure is increased inside the expandable system, the spindly carrying the upper disk moves upwards by virtue of the expansion of the expandable system against the force of gravity, thereby lifting the upper disk from the bottom disk and thus releasing the clamping brake. The strength of the braking effect is determined by the surface finish of the upper and bottom disks, but especially by the pressure of the upper disk on the bottom disk. This pressure can be created, e.g., by springs. In the preferred arrangement of the disk thread brake, in which its spindle is vertical, the pressure can be varied in an easily reproducible manner by means of upper disks of different weight.

The response times of the disk thread brake can be reduced by springs which counteract the expansion of the system. Springs also permit a different connection of the disk brake in which the upper disk is lifted off the bottom disk without pressurized gas and the upper disk is dropped on the bottom disk by the pressure of the gas. A particularly fast start of the braking action is thereby achieved when the rotation of the warping beam is stopped.

As the expandable system a metal container with an elastic cover may be used. This system is similar to the containers used in aneroidal barometers, but does not have an inside pressure spring. A compressed air connection or two plastic films glued together at the edges with a pressure gas feeder between the two films may also be used. However, a system is preferred that consists of cylinders and pistons, where the pressurized gas supply can be effected both through the piston and directly into the cylinder. In a first case, the piston is firmly connected to the housing, while the cylinder is arranged at or in the movable member. In a second case, it is appropriate to shape the cylinder and its gas supply as part of the housing and to connect the piston to the movable member in an appropriate manner. With the brake in its open position, the thread is not to be delayed by the brake. To this end, it has proved indicated to slot the spindle axially and to guide the thread rectilinearly through the slot and between the bottom and upper disks.

DETAILED DESCRIPTION OF THE PRESENTLY PREFERRED EMBODIMENTS

The First Embodiment

Figure 1:
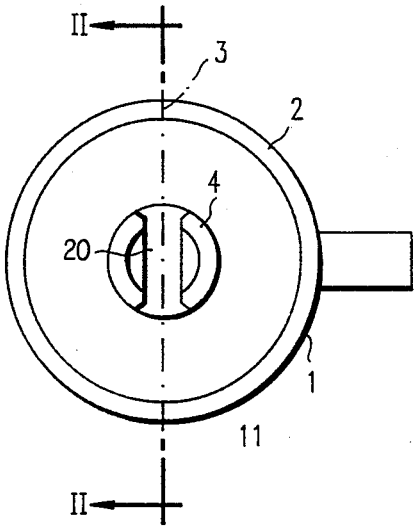
FIG. 1 is a plan view of a first embodiment of the invention with the upper disk removed.

FIG. 1 shows the disk thread brake of the invention in plan view with the upper disk removed. A bottom disk 11 is held by an outer ring 2 of a housing 1. A thread 3 runs through a slot in a spindle 4.

Figure 2:
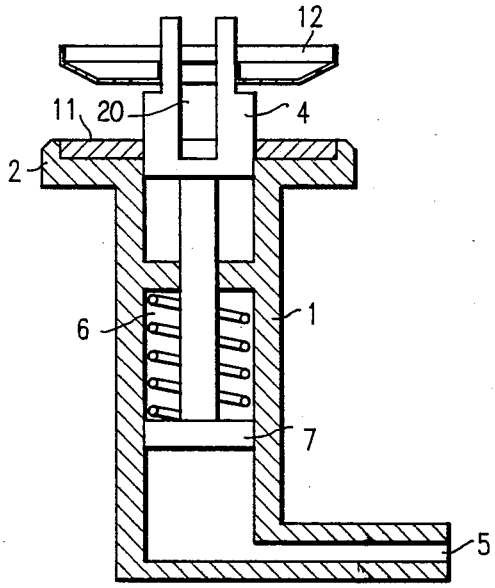
FIG. 2 is a vertical cross section on the line II—II in FIG. 1.

FIG. 2 shows a vertical cut through the thread brake. A piston 7 with attached to the spindle 4 is situated in the housing 1, which also contains a gas supply 5 and a cylinder 6. If pressurized gas is fed to the cylinder 6 by way of the gas supply 5, the piston 7 and the spindle 4 move upwards. An upper disk 12 is seated on a shoulder of the spindle 4, and it consequently is lifted off the bottom disk 11.

Springs (e.g., compression springs) can be provided between the housing 1 and the piston 7 in order to accelerate the dropping of the spindle 4 and the upper disk 12 after the pressurized gas supply is shut off and an outlet valve is opened.

The Second Embodiment

Figure 4:
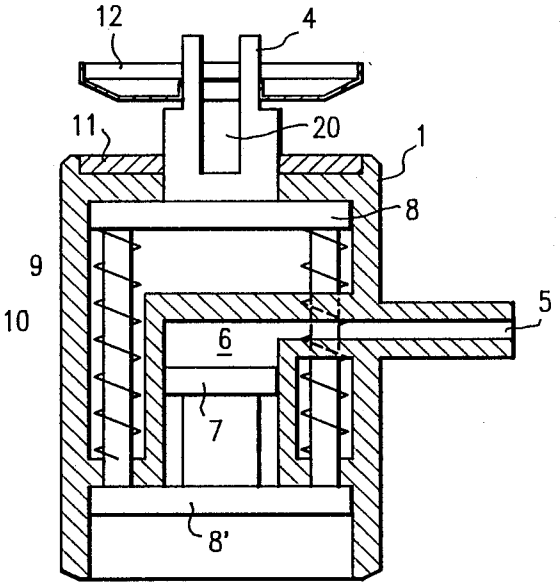
FIG. 4 is a vertical cross section of the second embodiment of the invention in its open condition. The spindle 4 has slot 20 for guiding a thread.
Figure 3:
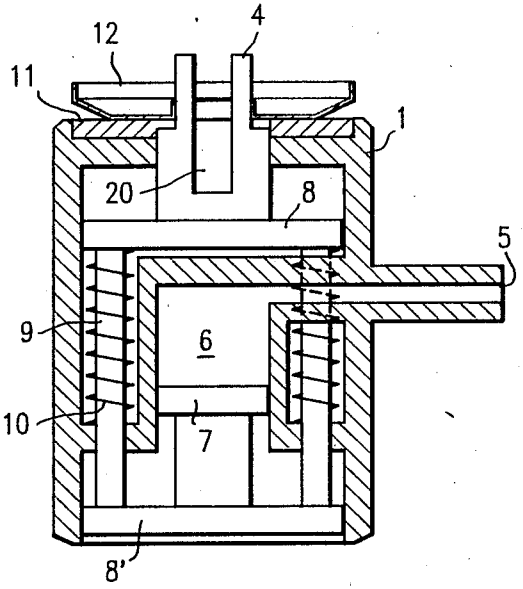
FIG. 3 is a vertical cross section of a second embodiment of the invention in its closed condition.

FIGS. 3 and 4 show a disk thread brake which, as shown in FIG. 4, has been opened without pressurized gas and which is closed by gas pressure (see FIG. 3). Here, the cylinder 6 and the gas supply 5 are firmly joined to the housing 1, while the piston 7 is joined to the spindle 4 by way of a bottom centering plate 8', connectors 9, and an upper centering plate 8, with the spindle 4 carrying on its shoulder the upper disk 12. Opening of the brake is effected by springs 10 bearing against the housing 1 and the upper centering plate 8.

Figure 5:
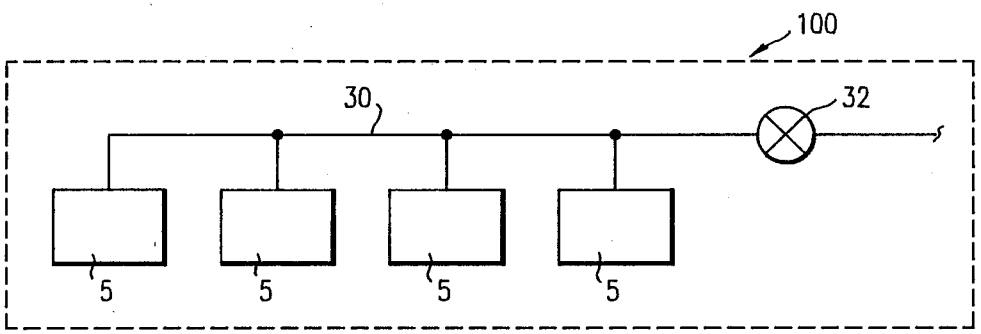
FIG. 5 is a schematic view of a plurality of clamping brakes in fluid communication with one another.

FIG. 5 shows a plurality of gas supply connections 5 for a plurality of clamping brakes in a warping mill 100 in fluid communication with one another via conduit 30 which is applied with compressed air via the valve 32.

Obviously, numerous modifications and variations of the present invention are possible in light of the above teachings. It is therefore to be understood that, within the scope of the appended claims, the invention may be practiced otherwise than as specifically described herein.

We claim:

1. In a warp mill for warping a plural number of threads, a clamping brake for each of the threads, comprising:

(a) a first brake disk:

(b) a second brake disk mounted on a spindle;

(c) a thread guide slot positioned in said spindle between said first and second brake discs, whereby a thread will be braked when said first and second brake discs are in proximity to one another, and (d) means for selectively moving said second brake disk relative to said first brake disk between a first position where said first and second brake discs are in proximity to one another and a second position where said first and second brake discs are not in proximity to one another, wherein said means for moving include means in fluid communication with all of said clamping brakes for applying a force of a pressurized gas to said second brake disc.

2. In a warp mill, a clamping brake as recited in claim 1 wherein said means comprise:

(a) a cylinder;

(b) a piston having a working face, said piston being slidably movable in said cylinder and being operatively connected to said second brake disk; and (c) means for supplying pressurized gas to the working face of said piston.

3. In a wrap mill, a clamping brake as recited in claim 1 and further comprising at least one spring that moves said second brake disk in the opposite direction from the direction in which said second brake disk is moved by said means for moving.

4. In a wrap mill, a clamping brake as recited in claim 1 wherein said means moves said second brake disk away from said first brake disk.

5. In a wrap mill, a clamping brake as recited in claim 1 wherein said means moves said second brake disk toward said first brake disk.

* * * * *